United States Patent [19]

Abouav

[11] Patent Number: 4,860,653

[45] Date of Patent: Aug. 29, 1989

[54] DETONATOR ACTUATOR

[75] Inventor: David M. Abouav, Victoria, Australia

[73] Assignees: D. J. Moorhouse; S. T. Deeley, both of Victoria, Australia

[21] Appl. No.: 46,918

[22] PCT Filed: Jun. 20, 1986

[86] PCT No.: PCT/AU86/00177

§ 371 Date: Feb. 26, 1987

§ 102(e) Date: Feb. 26, 1987

[87] PCT Pub. No.: WO87/00265

PCT Pub. Date: Jan. 15, 1987

[30] Foreign Application Priority Data

Jun. 28, 1985 [AU] Australia ..... PH1256
Jun. 28, 1985 [AU] Australia ..... PH1257
Jun. 28, 1985 [AU] Australia ..... PH1259

[51] Int. Cl.[4] ..... F42C 15/40
[52] U.S. Cl. ..... 102/200; 102/215
[58] Field of Search ..... 102/200, 202.5, 206, 102/215, 301, 311, 331, 332

[56] References Cited

U.S. PATENT DOCUMENTS

| | | | |
|---|---|---|---|
| 4,136,617 | 1/1979 | Fowler | 102/206 |
| 4,145,970 | 3/1979 | Hedberg et al. | 102/206 |
| 4,328,751 | 5/1982 | Oswald | 102/220 |
| 4,395,950 | 8/1983 | Oswald | 102/200 |
| 4,445,435 | 5/1984 | Oswald | 102/215 |
| 4,487,125 | 12/1984 | Zuk | 102/220 |
| 4,576,093 | 3/1986 | Snyder | 102/200 |
| 4,615,268 | 10/1986 | Nakano et al. | 102/200 |
| 4,674,047 | 6/1987 | Tyler et al. | 102/206 |

FOREIGN PATENT DOCUMENTS

| | | |
|---|---|---|
| 0098779 | 1/1984 | European Pat. Off. . |
| 0147688 | 7/1985 | European Pat. Off. . |
| 3114234 | 11/1982 | Fed. Rep. of Germany . |
| 3301251 | 6/1984 | Fed. Rep. of Germany . |
| 1526634 | 3/1976 | United Kingdom . |
| 2015791 | 1/1979 | United Kingdom . |
| 2075156 | 5/1981 | United Kingdom . |
| 2164730 | 8/1985 | United Kingdom . |

*Primary Examiner*—Charles T. Jordan
*Attorney, Agent, or Firm*—Cushman, Darby & Cushman

[57] ABSTRACT

An actuator for use in conjunction with a detonator for blasting comprises electronic circuitry which on receiving input signals generates an output arm signal to arm a detonator, and then after a predetermined delay an output actuate signal to fire the detonator and an associated explosive charge. The delay is capable of being remotely and precisely set. The actuator is preferably used in conjunction with a control device which has a microcomputer whose memory contains arm and actuate codes and which has both arm and actuate keys. This microcomputer is such that the actuate keys must be operated within a predetermined period after operation of the arm key, otherwise an actuate signal is not transmitted to the actuator.

6 Claims, 22 Drawing Sheets

FIG. 9

CONNECTION TABLE FOR FIGURE 8 CIRCUIT

| No. (Unit type) | 208 (8085) | 210 (8155) | 212 ($2716_D$) | 216 ($74377_{IN}$) | 216 ($74377_{OUT}$) | 212 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

START

218
Make det. safe
220
Wait for command
222
Inf'm'tion request
yes
Transducer input
224
no
226
CALIBRATE command
no
yes
230
Start Calib. timer
232
Wait for command
234
BLAST code
no
yes
236
Calculate delay
238
Reply to Control 14
240
ARM det. unit 22
A
A
Set 5 sec. timer
242
yes
t>5 sec
244
no
Rec'd command
yes
246
no
248
no
BOOM command ?
yes
Get calc'd delay
250
Wait delay
252
Actuate fusehead
258
Still alive ?
260
yes
Tell master 'not OK'
262

FIG. 12.

CONNECTION TABLE FOR FIGURE 11 CIRCUIT

| No. (Unit type) | 492 (8085) | 496 (8155) | 494 ($2716_D$) | 500 ($74377_{IN}$) | 500 ($74377_{OUT}$) | 494 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

FIG. 16.

CONNECTION TABLE FOR FIGURE 15 CIRCUIT

| No. (Unit type) | 344 (8085) | 348 (8155) | 346 ($2716_D$) | 350 ($74377_{IN}$) | 350 ($74377_{OUT}$) | 346 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

FIG. 20.

CONNECTION TABLE FOR FIGURE 19 CIRCUIT

| No. (Unit type) | 438 (8085) | 442 (8155) | 440 ($2716_D$) | 446 ($74377_{IN}$) | 446 ($74377_{OUT}$) | 440 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

FIG. 23

CONNECTION TABLE FOR FIGURE 22 CIRCUIT

| No. (Unit type) | 468 (8085) | 472 (8155) | 470 ($2716_D$) | 476 ($74377_{IN}$) | 476 ($74377_{OUT}$) | 470 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

DETONATOR ACTUATOR

This invention relates to an actuator to be used with a detonator and to a detonator-actuating system for use in blasting.

BACKGROUND ART

A conventional blasting system comprises a series of explosive charges which are detonated by detonators which are wired to a remote command source. In order to prevent breakage of the wiring connecting detonators set to go off late in the blasting by earlier explosions, the detonators are provided with delays, such that the last detonator to explode has received its firing signal prior to the explosion of the first. Recent improvements in the system have included electronic delays (replacing the older, less precise pyrotechnic delays), and the ability to program such delays in situ. German Offenlegungsschrift 3301251 provides an example of the versatility of which these systems are capable.

There has recently been provided in my copending Australian Patent Application Number PH1255 a detonator which comprises conditioning means which renders fusehead conductors incapable of carrying a voltage or current capable of firing the detonator prior to the altering of the conditioning means from a "normal" (incapable of being fired) state to an "armed" state. This provides a considerable safety factor not previously present in detonators.

DISCLOSURE OF INVENTION

I have now found that it is possible to maximise this safety factor by using such detonators in combination with a particular actuating system. I therefore provide, according to the present invention, an actuator for a detonator, characterised in that the actuator comprises control circuitry which is responsive to input signals from the control device applied to inputs thereof, said control circuitry being operable, on receipt of at least one predetermined input signal, to (i) generate an output arm signal which is applied in use to the detonator and render it capable of being actuated and (ii) generate an output actuate signal which is applied to the detonator after a predetermined delay relative to said predetermined input signals to cause explosive actuation of the detonator.

By "actuator" I mean a unit whose function is to receive signals from a control device, and to actuate a detonator. The type of detonator with which an actuator of the type used in this invention is associated may be one which must be armed before it can be detonated. An especially preferred type is described in my copending Australian Patent Application No. PH1255. However, the actuators according to my invention may be used in association with conventional detonators by, for example, connecting the detonator with the actuator such that only the actuate signal is transmitted to the detonator. By "associated", I mean that the detonator and the actuator may be connected in some way such that signals may be passed from actuator to detonator. This may be achieved, for example, by wiring the two components together, or by incorporating the actuator within the detonator. However, in a preferred embodiment, the actuator and detonator are in modular housings, and are simply connected together prior to putting into a blasthole. In this case, all the appropriate electrical connections are made by the connection of the modular housings.

The actuator for use in this invention incorporates the delay which is so important in large-scale commercial blasting. The specific length of delay may be built into the actuator during manufacture, but I prefer to have the delay programmable; this confers considerable versatility on the system. Thus, an actuator may be programmed electronically prior to its being inserted in a blasthole. Even more versatility is conferred by having the actuator programmable when the detonator is in place in the blasthole via the means through which the input signals are transmitted. Thus, a blast pattern can be altered at will and in complete safety up to the time of sending of the input arm and input actuate signals.

The electronic circuitry within the actuator stores delay information and acts on an appropriate signal or appropriate signals from the control device to generate output arm and output actuate signals separated by a selected delay time. Preferably, the circuitry will comprise a microcomputer with a memory which stores at least both an arm code and an actuate code and preferably also the selected delay time. The microcomputer analyses input signals, and when it identifies a predetermined signal or predetermined signals it then causes to be generated appropriate corresponding output arm and actuate signals.

The nature of the signal received by the actuator may be any suitable signal known to the art. It may be, for example, a single signal, and the circuitry of the actuator may be such that this signal can cause the generation, by reference to the arm and actuate codes and the predetermined delay stored in the actuator circuitry, of both arm and actuate signals, separated by a predetermined delay. A typical signal of this type is a voltage which is in excess of a predetermined level. Other signals may comprise both an arm code and an actuate code, for example, a voltage step signal wherein the leading edge of the signal comprises an arm signal and the trailing edge an actuate signal. I prefer, however, that both arm and actuate signals be digital signals. This has a number of advantages. It means that if the actuator is conditioned to recognise certain digital codes, it will act only on those codes. Accidental or unauthorised firing can thus be almost completely eliminated.

The nature of the signal or signals transmitted by the actuator to the detonator may be any convenient signal suitable for the purposes of actuating the detonator. In the case of a conventional detonator, it may be a simple voltage or current suitable for causing the ignition of a flashing mixture and the consequent explosion of the detonator. However, the signal preferably comprises a multi-bit digital code; when such a signalling system is used with a preferred detonator as described in my co-pending Australian Patent Application No. PH 1255, it permits of degrees of security and safety not attainable with known detonating systems.

The power to drive the actuator and the detonator itself may be provided by an convenient means, consistent with the fact that a detonator set to explode late in a series of blasts should not be prone to failure by the breakage by an earlier explosion of a wire connection thereto. The power source for the arming and actuating of the detonator should therefore be in close proximity to the actuator and preferably either enclosed within the actuator housing or capable of being connected to it.

The power source may be a battery, or preferably a temporary power source such as a capacitor which is charged by signals from the surface. In an especially preferred embodiment of my invention, the capacitor is housed in a separate modular unit which can be attached to the detonator and actuator units, such that they form an integral unit with internal wiring and connections appropriately joined by the act of joining together the individual modular units.

The actuator receives its signals from a control device on the surface. This may be a remote exploder box of the type well known to the art. However, when the actuators of my invention are used in conjunction with a selected control device, the result is a detonator actuating system of remarkable versatility and safety. I therefore also provide a detonator actuating system comprising (a) an actuator as hereinabove described associated with a detonator which has an explosive charge; and (b) a control device for controlling by means of signals to the actuator the operation of the detonator.

the system being further characterised in that the control device comprises a microcomputer having a memory which stores at least an arm code and an actuate code, and wherein the microcomputer has an arm key which upon actuation by a user causes generation and emission to the actuator of an arm signal derived from the arm code, and an actuate key which upon actuation by a user causes generation and emission of an actuate signal derived from the actuate code, the microcomputer being such that the actuate key must be actuated within a predetermined period after actuation of the arm key otherwise the actuate signal is not transmitted to said actuator.

My invention additionally provides a control device suitable for use in a detonator actuating system as hereinabove described, and a method of blasting using such a system.

The control device which acts in concert with the actuator is adapted to control a plurality of detonators. It comprises a microcomputer with at least arm and actuate codes, and arm and actuate keys which, when operated, act to generate arm and actuate signals and send them to the actuator. The microcomputer is such that the actuator key must be operated within a predetermined period after operation of the arm key, otherwise no actuate signal is transmitted. This feature adds a further useful margin of safety to an already very safe system.

Preferably the memory additionally stores a reset code and the microcomputer operates to generate an output reset signal derived from the reset code if the actuate key is not actuated within the predetermined period after actuation of the arm key, the output reset signal rendering the detonators incapable of being explosively actuated until a predetermined sequence of output arm and actuate signals is received. It follows of course, that the actuator must have appropriate circuitry which permits of this resetting function.

In a further preferred embodiment, the delay of the actuator unit may be calibrated from the control device. This may be achieved by having an actuator unit which is responsive to calibrate signals and the microcomputer of the control device is arranged to generate an output calibrate signal in response to actuation of a calibrate key or a programmed instruction whereupon timing means in the control circuitry of the actuator unit is actuated for a period terminated by a control signal from the control device, the output of the timing means being stored in the control circuitry whereby a delay period stored therein can be calibrated on a time basis relative to the control device. It is possible to incorporate the calibration function in the control device such that it is automatically carried out when the arm key is operated.

As hereinabove stated, it is possible not only to calibrate the delay times for accurate detonation but also to program them from the surface. This can be done from a suitably equipped control device. A further considerable advantage of my invention is that the calibration may be carried out only seconds before the actual blast, and the calibration signals may be part of the blast signal itself. This allows the use of low-cost components and reduces costs considerably.

In one preferred embodiment of my invention, the actuator may be equipped with a transducer unit which is couplable thereto such that all the appropriate electrical connections are made by the coupling. As is well known in the art, a transducer is an electronic device which is responsive to a preselected physical parameter (for example, pressure or temperature) and which produces corresponding condition signals which may then be sent, for example, to a measuring instrument or to an apparatus affected by the parameter so as to modify its behaviour. In this case, information from a transducer may be used to vary the calibration of the actuator, and any variation is communicated back to the control device at the surface, which control device is capable of receiving such signals. The actuator can thus "talk back" to the control device and this permits much tighter control over blasting operations.

In some embodiments, the control device may include a connector which enables direct connection with the control circuitry of the actuator units so as to read data stored in the actuator unit. That data might for instance comprise an identity code of the user, a code number assigned to a particular blast, and the delay period programmed into the detonator control circuitry. The control device may include a display such as an LCD display or a VDU for displaying this information to the user. In a further embodiment of my invention, the detonators may be receptive to control signals which prevent them from operating, and the control device may comprise circuitry which sends to the detonators a continuous stream of control signals which prevents any accidental or inadvertent firing. Suitable circuitry is described in my co-pending Australian Patent Application No. PH1258.

The invention will now be further described with reference to the following drawings:

BRIEF DESCRIPTION OF DRAWINGS

FIG. 9 is a connection table showing the connections of the components of FIG. 8;

FIG. 12 is a connection table showing the connections of the components of FIG. 10;

FIG. 16 is a connection table showing the connections of the components of FIG. 15.

FIG. 20 is a connection table showing the connections of the components of FIG. 19;

FIG. 23 is a connection table showing the connections of the components of FIG. 22.

MODES OF CARRYING OUT THE INVENTION

Figure 1:
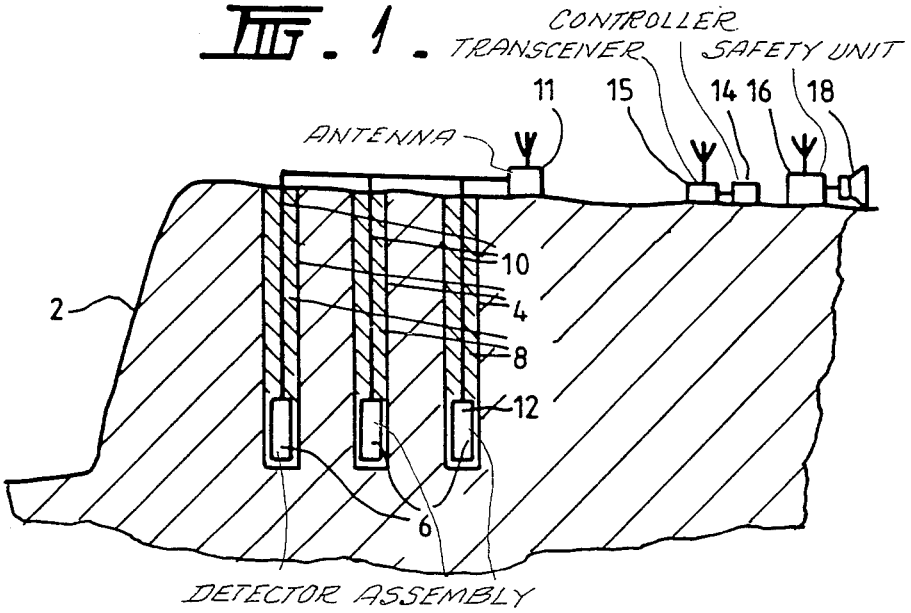
FIG. 1 is a schematic view of a quarry having a plurality of charges arranged to be activated by remote control.

FIG. 1 shows a quarry face 2 and a number of charge holes 4 drilled into the ground behind the face. A detonator assembly 6 is located in each hole 4 and the remainder of the hole is filled with a bulk charge 8 such as ammonium nitrate fuel oil mixture which is supplied as a powder or slurry, in accordance with known practice. The detonator assemblies 6 are connected by conductors 10 to an antenna 11 for a radio transceiver 12 located in one or more of the assemblies 6. The transceiver 12 receives control signals from a controller 14 via a transceiver 15 so that the detonator assemblies can be actuated by remote control. A site safety unit 16 may also be provided to provide additional safety during laying of the charges. The unit 16 is preferably located near the antenna 11 so as to be likely to pick up all signals received by the antenna 11. The safety unit 16 includes a loudspeaker 18 which is operated in emergency conditions and prior to a blast. The detonator assemblies 6 are arranged to be actuated at an accurately determined time after the controller 14 has transmitted signals for the blast to commence. The detonator assemblies 6 can be arranged to be activated in a precisely defined time sequence so that efficient use is made of the blasting materials. The number of blast holes 4 can of course be very considerable. For instance, in some large scale mining and quarrying operations up to 2000 holes are sometimes required in a single blasting operation.

Figure 2:
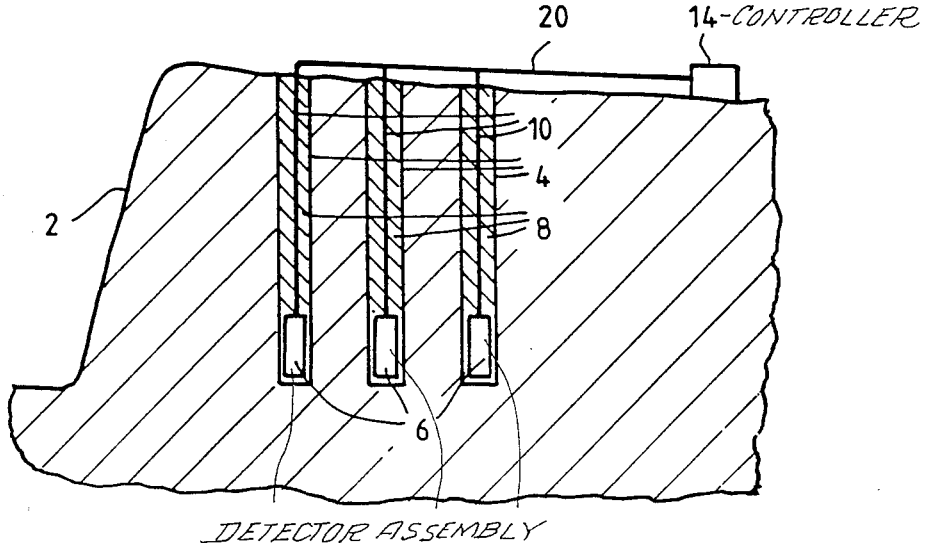
FIG. 2 is a similar view but showing an arrangement in which the charges are set off by a direct wire connection.

FIG. 2 shows an arrangement which is similar to FIG. 1 except that communication from the controller 14 to the detonator assemblies 6 is via a wire 20 extending from the controller 14 to the conductors 10. In this case the safety unit 16 is not required because of the hard wire connection between the controller 14 and the detonator assemblies 6, but it could be coupled to the wires 20 so as to sound an alarm when signals are detected for causing actuation of the detonator assemblies.

Figure 3:
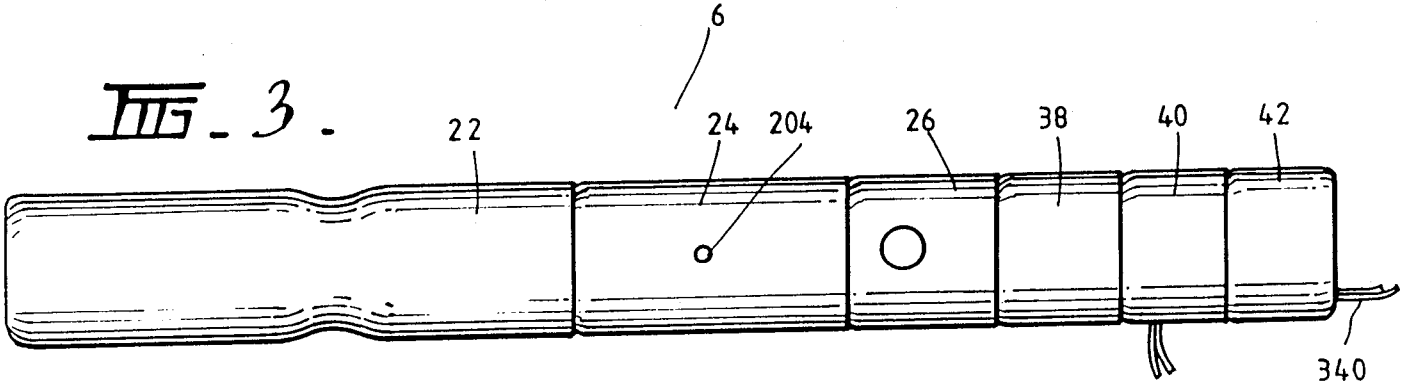
FIG. 3 is a side view of a detonator assembly.

FIG. 3 shows the detonator assembly 6 in more detail. As will be described hereinafter, it comprises a number of interconnected modules which can be varied in accordance with requirements. In the illustrated arrangement the modules comprise a detonator unit 22, an actuator unit 24, a transducer unit 26, a battery unit 38, an expander unit 40 and a connector unit 42. The units themselves can be made with various modifications as will be explained hereinafter. Generally speaking however a detonator assembly 6 in a useful configuration will include at least the following units: a detonator unit 22, an actuator unit 24, a battery unit 38 and a connector unit 42.

Figure 4:
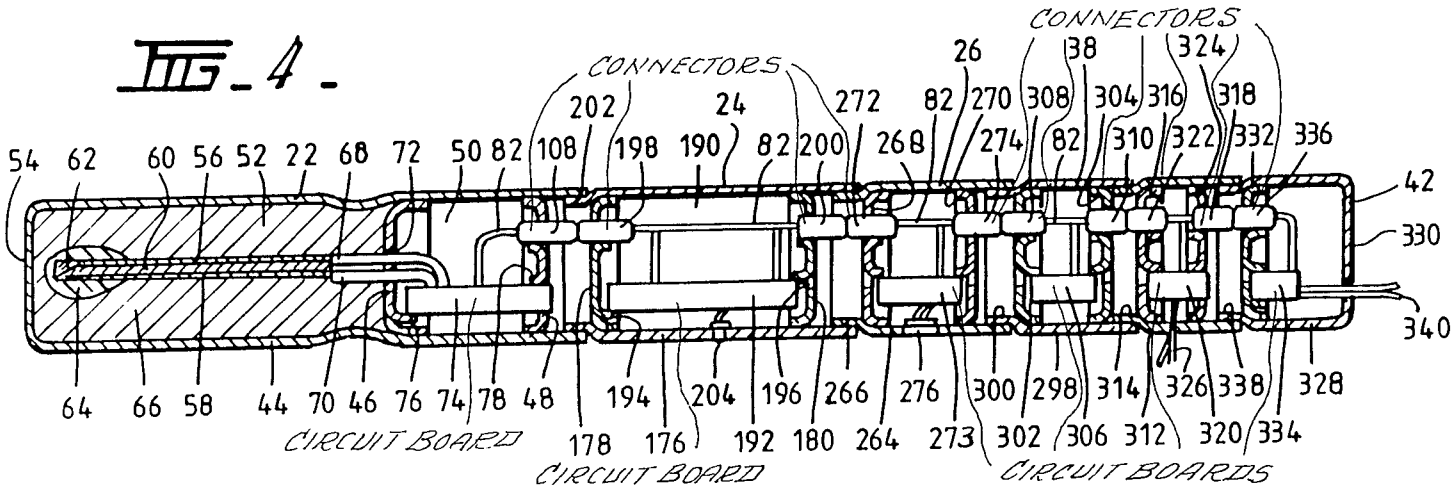
FIG. 4 is a schematic sectional view through the detonator assembly of FIG. 3.

FIG. 4 shows a longitudinal cross section through the detonator assembly 6 revealing in schematic form the physical layout of the components.

The detonator unit 22 comprises a tubular housing 44 which for instance might be formed from aluminium, or a resilient material which is a conductor such as carbonised rubber. The housing 44 is provided with transverse partitions 46 and 48 press fit into the housing 44. A first chamber 50 is formed between the partitions 46 and 48 and a second chamber 52 is formed between the partition 46 and the closed end wall 54 of the housing. Extending into the second chamber 52 are two fusehead conductors 56 and 58 separated by an insulating block 60. The conductors 56 and 58 are connected to a fusible element 62 located within a flashing mixture charge 64. The remainder of the second chamber 52 is filled or partly filled with a base charge 66 of explosive material. The conductors 56 and 58 include insulated portions 68 and 70 which extend through an opening 72 in the partition 46 and into the first chamber 50.

Located within the first chamber 50 is a circuit board 74 which mounts electronic and/or electric components. The board 74 is supported by tabs 76 and 78 pressed from the partitions 46 and 48. The partition 48 also supports a multiport connector 108 for a bus 82.

Figure 5:
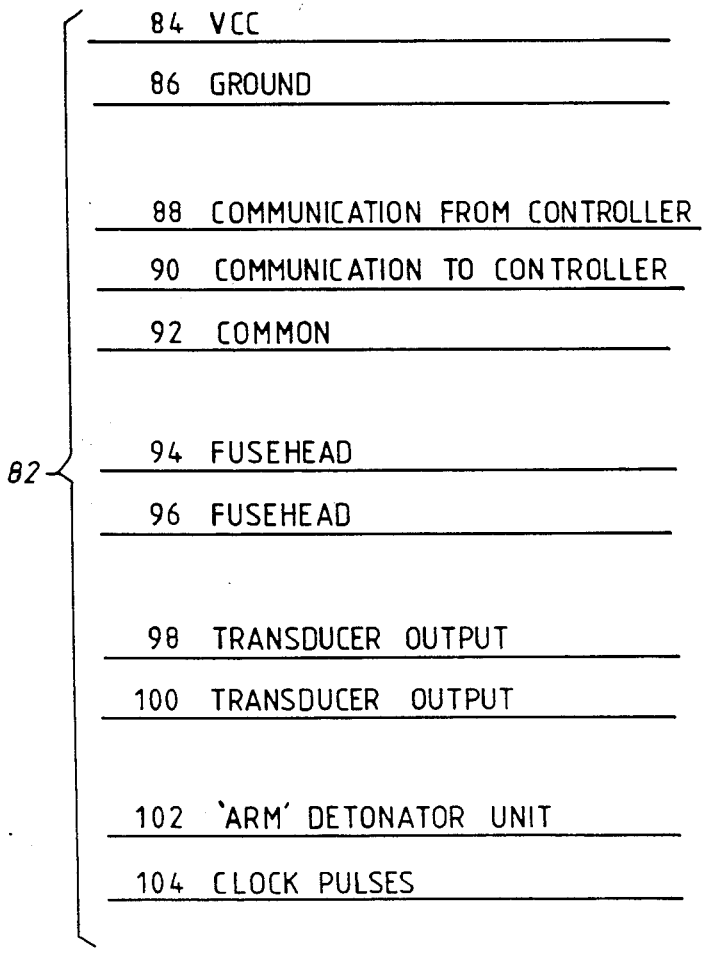
FIG. 5 is a schematic view of lines in a communication bus.

The bus 82 has multiple lines which enable electrical interconnection of the various modular units although not all of the lines are required for the functioning of particular units. FIG. 5 shows schematically the various lines in the bus 82 for the illustrated arrangement. In this case there are 11 lines 84, 86, 88, 90, 92, 94, 96, 98, 100, 102 and 104, some of which are required for the operation of the circuitry on the board 74 of the detonator unit 22.

Figure 6:
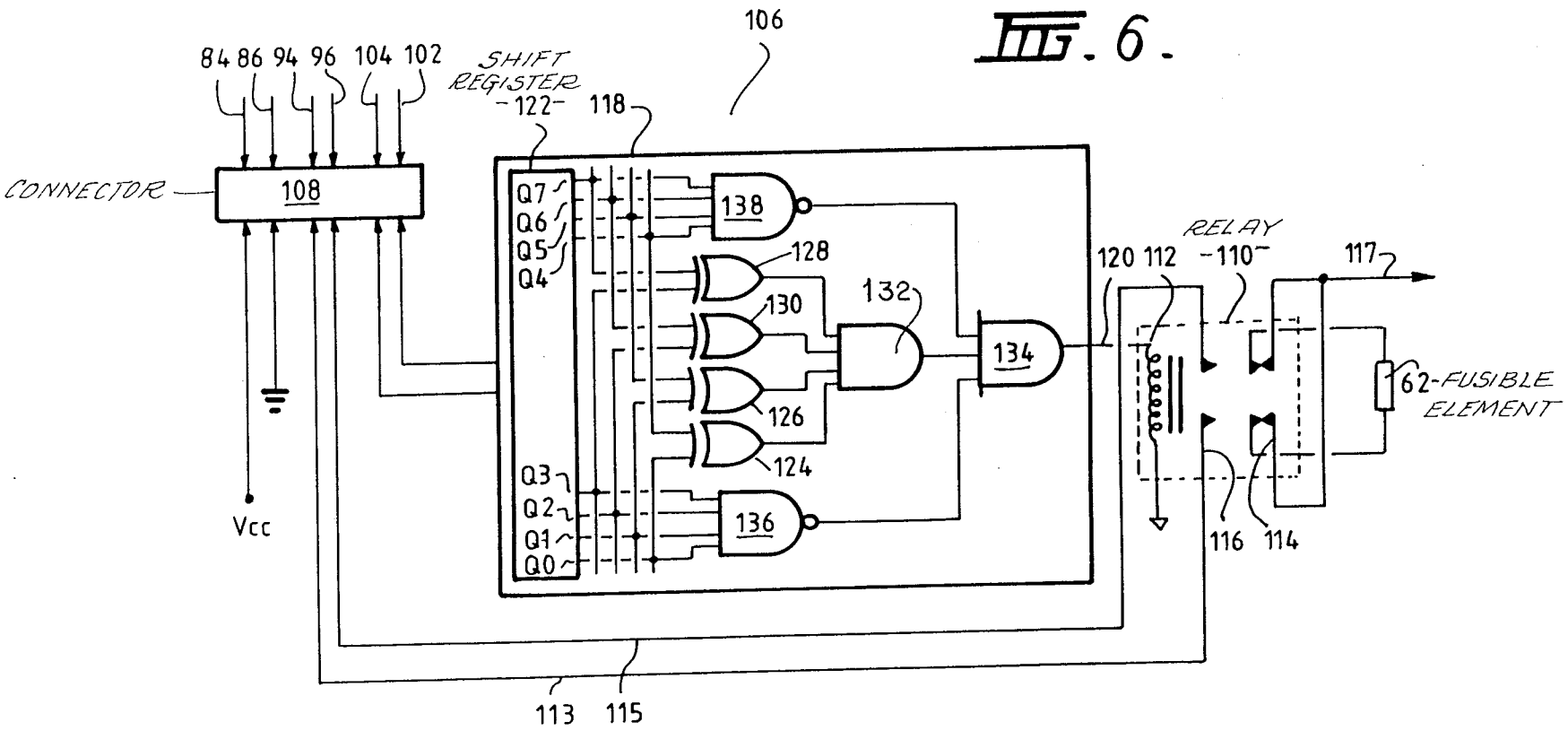
FIG. 6 shows the circuitry of one embodiment of a conditioning means according to the invention.

FIG. 6 illustrates diagrammatically a circuit 106 which is mounted on the board 74 of the unit 22. The circuit 106 includes a connector 108 which allows connection to selected lines in the bus 82. In the illustrated arrangement, the line 84 is a voltage supply line and the line 86 is a ground line for the supply. The lines 94 and 96 carry, at appropriate times, high currents which enable fusing of the fusing element 62. The line 104 carries clock pulses whereas the line 102 carries an ARM signal which places the detonator unit 22 in a "armed" state so that it can be activated on receipt of appropriate driving currents on the lines 94 and 96. In the illustrated arrangement, the signals and currents on the lines 94, 96, 102 and 104 are derived from the actuator unit 24. The power supply lines 84 and 86 are coupled to receive power from the battery unit 38.

The circuit 106 includes a relay 110 having a driving coil 112, normally closed contacts 114 and normally open contacts 116 which are connected to conductors 113 and 115 which are connected to the lines 94 and 96 via connector 108. The normally closed contacts 114 are connected by means of conductors 117 to the aluminium housing 44 so that both sides of the fusible elements 62 are shorted directly to the housing. This is an important safety factor because the detonator unit 22 cannot be activated unless the relay 110 is operated. This protects the unit 22 from unwanted operation caused by stray currents or radio frequency electromagnetic radiation. In the illustrated arrangement, the relay 110 is not operated until just before signals are delivered to the lines 94 and 96 for activation of the detonator unit. The arrangement therefore has the advantage that until just prior to when the detonator unit 22 is activated, the fuse head conductors 56 and 58 cannot receive any electromagnetic or electrostatic charges which might inadvertently fuse the element 62.

The operating coil 112 of the relay is connected to a logic circuit 118 which receives input from lines 102 and 104. The preferred arrangement is that the circuit 118 must receive an ARM signal comprising a two part four bit code on the line 102 in order to produce an output on line 120 which activates the relay.

The circuit 118 includes a 74164 eight bit shift register 122 having eight output lines $Q_0$–$Q_7$. The circuit further includes four exclusive OR gates 124, 126, 128 and 130 connected to pairs of outputs from the shift register 122. The outputs of the exclusive OR gates are gated in a four input AND gate 132, the output of which is in turn connected to one input of a three input high current AND gate 134. The circuit further includes a four input NAND gate 136 connected to the first four outputs of the register 122 and a second NAND gate 138 connected to the second four outputs of the register 122. The outputs from the NAND gates 136 and 138 are connected to the remaining two inputs of the AND gate 134. The configuration of the gates connected to the outputs $Q_0$–$Q_7$ of the register 122 is such that only selected eight bit signals on the line 102 will cause a signal to appear on the output 120 for activating the relay. The signal must be such that the first four bits are exactly the complement of the second four bits and further the first four bits cannot be all 1's or all 0's. The latter requirements are important in practice because it prevents erroneous operation of the circuit 118 in the event that a circuit fault causing a high level or short circuit to be applied to the line 102. The circuit 106 illustrated above is given by way of example only and it would be apparent that many alternative circuits could be used. If at any time a signal is received on line 102 which is not an ARM signal the output line 120 will go low and deactivate the relay 110. The controller 14 may generate RESET signals for this purpose. In any event the logic circuitry 118 will cause the output 120 to go low if any signal other than an ARM signal is received. The following are examples of valid ARM signals

00011110

10000111

01001011.

Further, the circuit 106 could be integrated if required, except for the relay.

Figure 7:
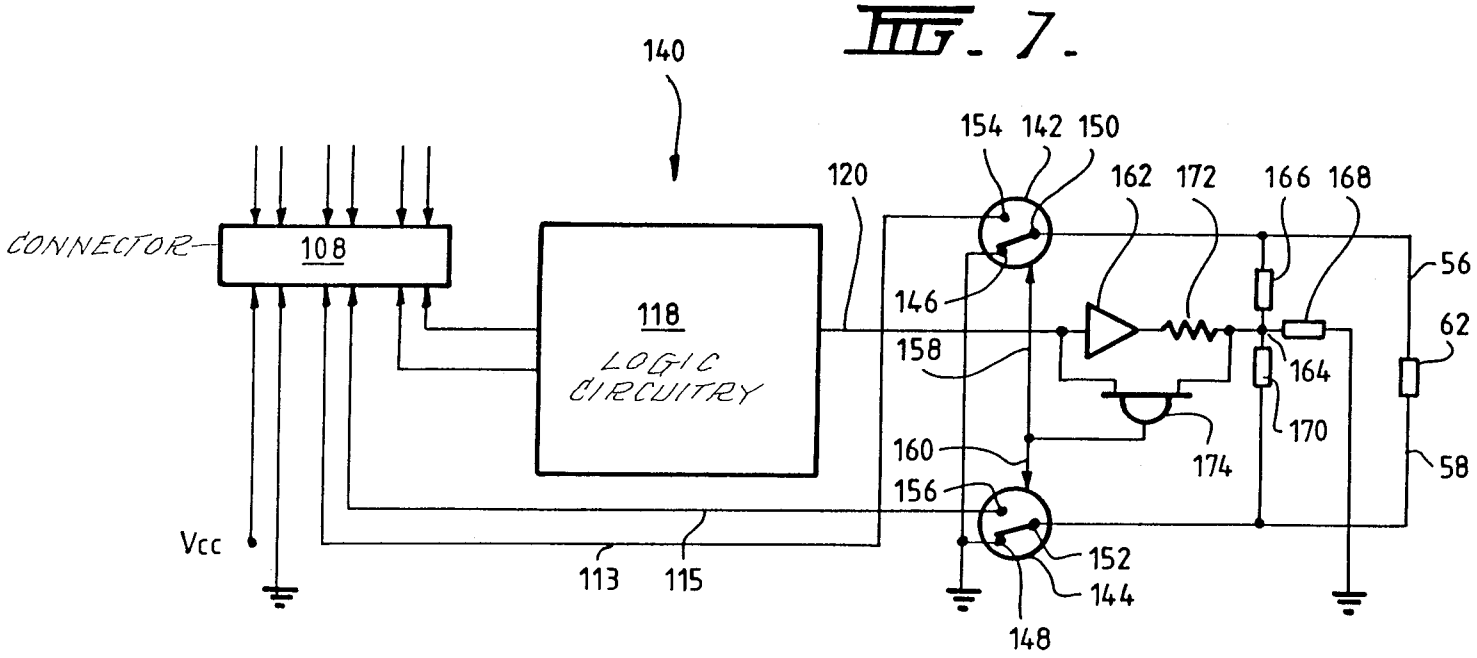
FIG. 7 shows the circuitry of another embodiment of a detonator unit.

FIG. 7 illustrates an alternative circuit 140 for the detonator unit 22. The inputs from the bus 82 to the connector 108 are the same as for the circuit 106 and the logic circuitry 118 is also the same as for the circuit 106. An alternative arrangement is however employed to ensure that the lines 94 and 96 are not electrically connected to the fusible element 62 until just prior to actuation on receipt of a correctly coded signal to the logic circuitry 118. In this arrangement, the circuit includes two solid state relays 142 and 144. The relays have electrodes 146 and 148 which are permanently connected to ground. The relays include electrodes 150 and 152 which are connected to the insulated portions of the conductors 56 and 58 leading to the fusible element 62. The relays are such that the electrodes 146 and 150 and the electrodes 148 and 152 are internally connected so that both conductors 56 and 58 are grounded and connected to the housing 44. The relays include electrodes 154 and 156 which are connected to the lines 94 and 96 via conductors 113 and 115. When the relays receive triggering signals on trigger electrodes 158 and 160 the internal connections change so that the electrodes 150 and 154 and the electrodes 152 and 156 are internally connected. In this case the conductors 56 and 58 are no longer grounded and are electrically connected to the lines 94 and 96 in readiness for activation of the fusible element 62. Triggering of the relays depends upon the output line 120 from the logic circuitry 118 as will hereinafter be explained.

The output line 120 from the circuitry 118 is connected to the input of an amplifier 162 which is connected to the junction 164 of three fusible links 166, 168 and 170 via a resistance 172. The circuit includes an AND gate 174 one input of which is connected to the output line 120 and the other input of which is connected to the junction 164. Output from the gate 174 is connected to the trigger terminals 158 and 160 of the relays. The arrangement is such that during normal operation both inputs to the gate 174 are low so that the relays are not triggered. When however a correctly coded signal is present on the line 102, the output line 120 of the circuitry 118 will go high to a sufficient extent whereby the fusible links 164, 166 and 168 will rupture. When all links have been ruptured the junction 164 will be high and hence the gates 174 will go high and the relays will be triggered. This couples the conductors 56 and 58 to the lines 94, 96 in readiness for actuation. It will be appreciated that until the logic circuitry 118 detects a correctly coded signal, the fusible element 62 is protected by the fusible links 166, 168 and 170. The arrangement prevents inadvertent charges or currents being developed in the conductors 56 and 58 due to stray electromagnetic or electrostatic fields.

The detonator actuator 24 illustrated in FIGS. 3 and 4 includes a tubular housing 176 preferably formed from aluminium. The unit includes partitions 178 and 180 which define a chamber 190 in which a circuit board 192 for electric and/or electronic components are mounted. The board 192 is supported by tabs 194 and 196 pressed from the partitions. The bus 82 extends through the chamber 190 and is connected at either end to connectors 198 and 200. One end of the housing 176 is formed with a keyed reduced diameter spigot portion 202 which in use is received in the free end of the housing 44 of the detonator unit 22. The arrangement is such that when the spigot portion 202 is interlocked with the housing 44 the connectors 198 and 108 establish appropriate connections for the various lines of the bus 82. The actuator unit 24 may include an LED 204 which can be mounted so as to be visible when illuminated from the exterior of the actuator unit 24.

The actuator unit 24 performs a variety of functions in the detonator assembly 6. Generally speaking, it ensures that the detonator unit 22 is actuated only in response to correctly received signals from the controller 14 and at an exactly defined instant of time. Other functions of the actuator unit 24 are to ensure correct operation of the other units in the assembly on interconnection of the various units and to control the operation of the transducer unit 26.

Figure 8:
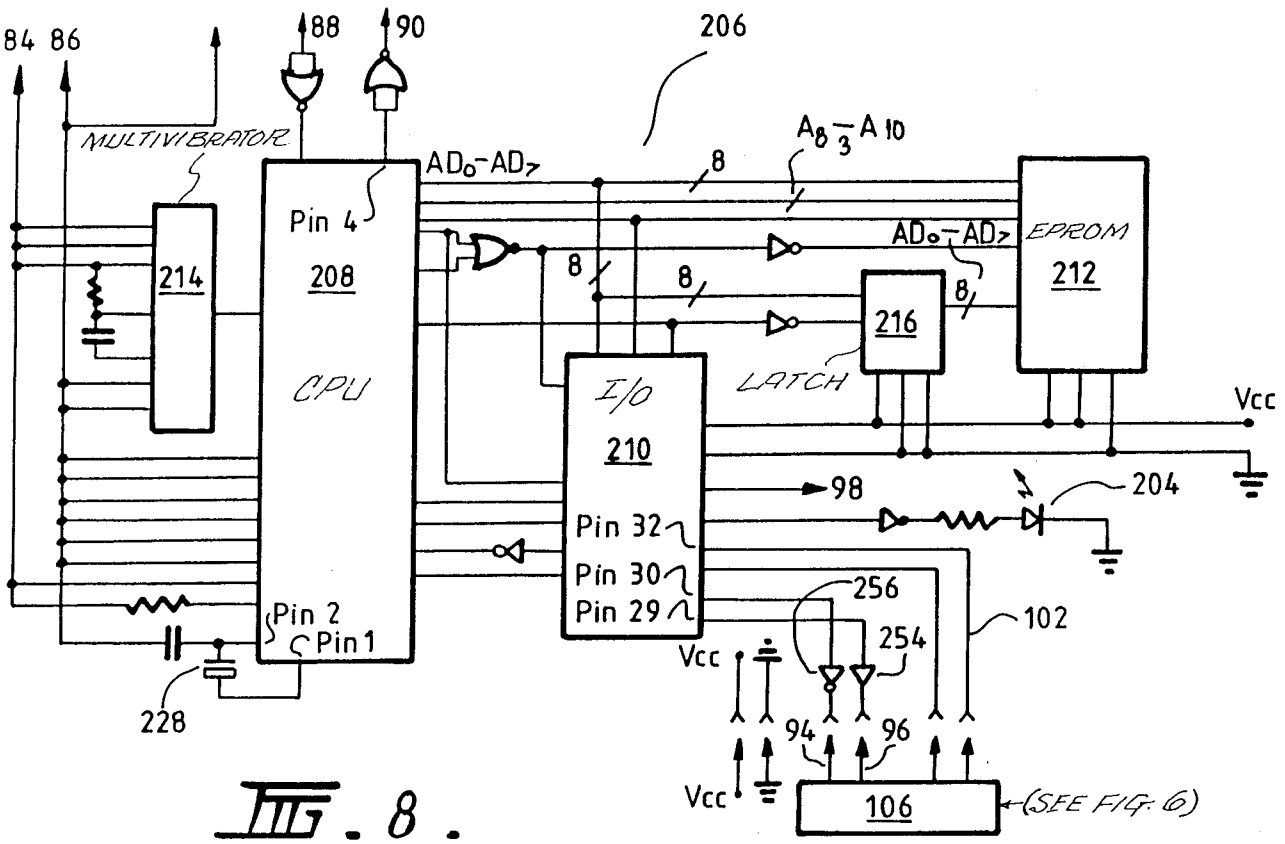
FIG. 8 is a schematic circuit diagram for an embodiment of a detonator actuator unit.

FIG. 8 shows in schematic form one arrangement for the circuitry 206 mounted on the board 192 in the actuator unit 24. The circuitry 206 generally speaking includes a microcomputer with memory to store programmes and data for correct operation of the unit 24 as well as the other units of the assembly. The data includes data relative to the precise delay required for actuation of the detonator unit 22 following generation of a blast commence signal (or BOOM command) from the controller 14. Further, the stored programme provides for calibration of a crystal clock in the circuitry 206 by the controller 14 just prior to operation. This ensures a high level of accuracy of all the time based functions of the assembly 6 which is therefore not dependent upon accurately selected components in the circuit 206. Further the accuracy would not be influenced by temperatures and pressures in the blast holes 4 at a blasting site.

The circuit 206 includes an 8085 CPU 208, an 8155 input/output unit 210, a 2716 EPROM 212, a 74123 monostable retriggerable multivibrator 214 and a 74377 eight bit latch 216. The components are connected together as indicated in the connection table (FIG. 9) SO as to function as a microcomputer, as known in the art.

Figure 10:
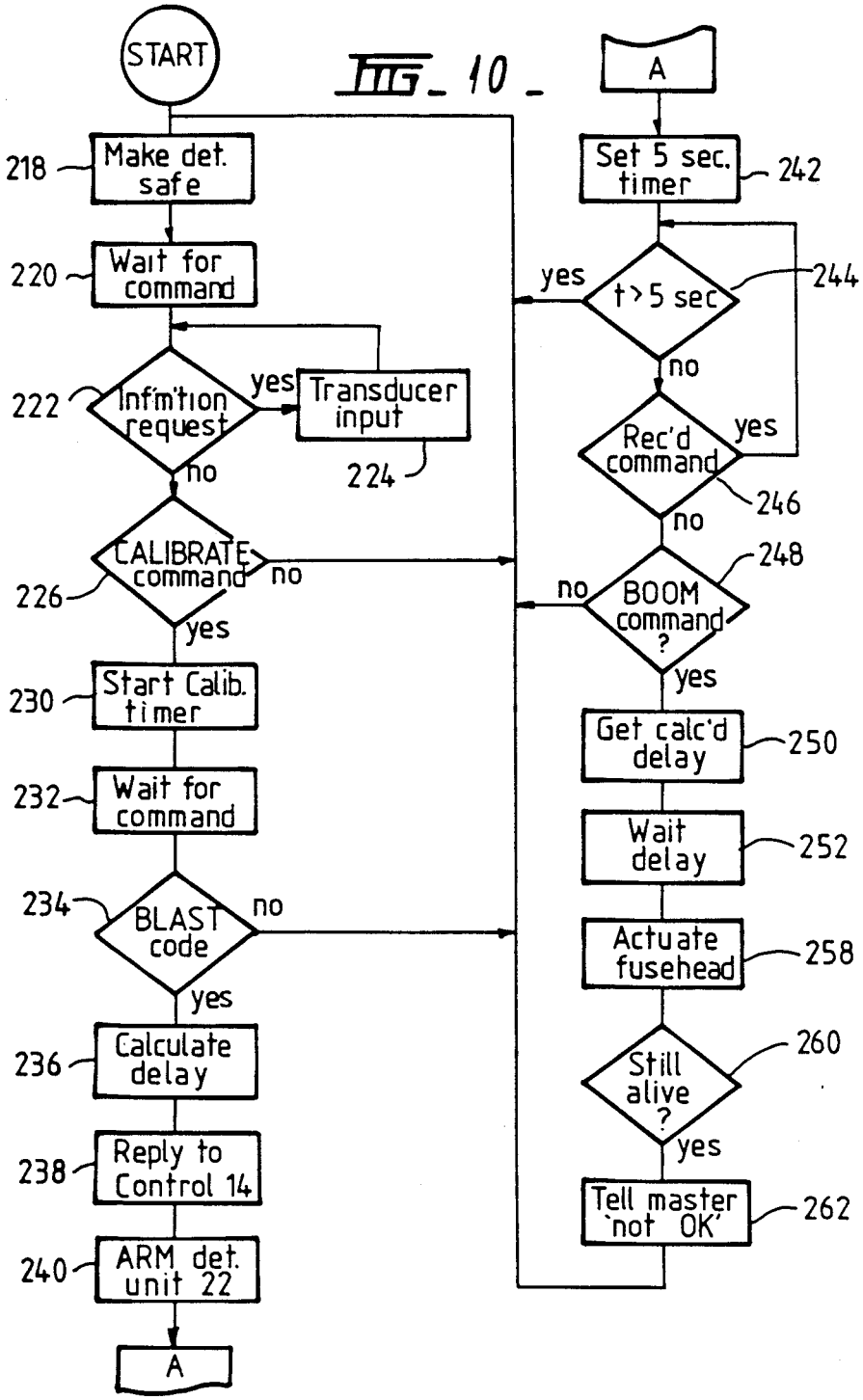
FIG. 10 is a flow diagram illustrating the operation of the detonator actuator unit of FIG. 8.

FIG. 10 shows schematically a flow chart of some of the programme functions which are carried out by the microcomputer 206. When power is supplied to the circuit by connection of the battery unit 38 in the detonator assembly 6 a power supply voltage and ground are established on the lines 84 and 86. The multivibrator circuit 214 ensures that the CPU 208 is reset on power up. The first programming function performed by the microcomputer is to ensure that the detonator units 22 are made safe. This is accomplished by sending eight consecutive zeros from pin 32 of the input/output device 210, the pin 32 being connected to the line 102. This ensures that the register 122 in the detonator 22 is initialised to zero and accordingly the unit 22 cannot be activated because of the arrangement of the logic circuitry 118. This step is indicated by the functional block 218 in FIG. 10.

Figure 14:
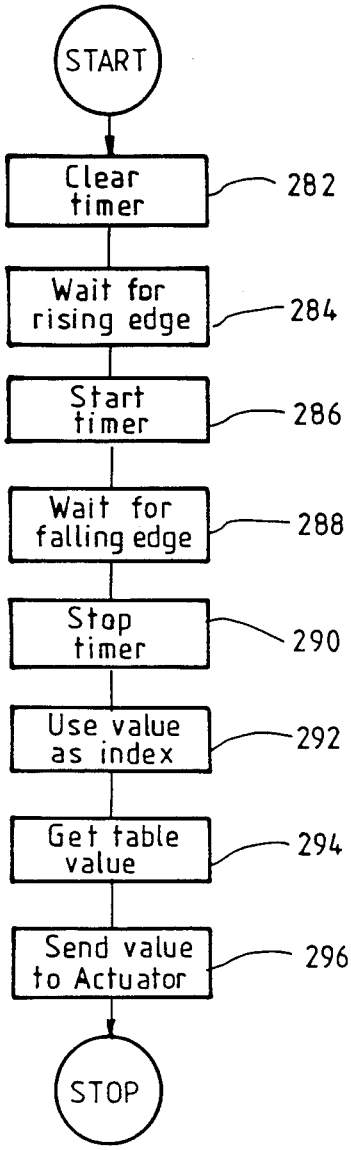
FIG. 14 is a flow diagram for the operation of a transducer programme.

After initialisation, the microcomputer waits for a command from the controller 14 as indicated by programming step 220. Commands from the controller 14 are received by the connector unit 42 and are then transmitted on the line 88 of the bus 82. The command signals on line 88 preferably comprises eight bit codes in which different bit patterns represent different commands. Typical command signals would be for (a) a request for information from the transducer unit 26, (b) a CALIBRATE command to commence calibration procedures, (c) a BLAST code for arming the detonator units 22, (d) a BOOM command for exploding the units 22, or a RESET command for resetting the units 22. Accordingly, FIG. 10 shows a question box 222 which determines whether the signal on the line 88 is a request for information from the transducer unit 26. If the signal is the appropriate signal the programme will then enter a sub-routine indicated by programme step 224 to execute the transducer interrogation and transmission programme. A flow chart for this programme is shown in FIG. 14. After execution of the transducer programme, the main programme returns to the question box 222. The signal on the line 88 will then no longer be a request for information from the transducer. The programme will then pass to the next question box 226 which determines whether a signal is on the line 88 is a CALIBRATE command appropriate for commencement of calibration procedures. This is indicated in the flow chart by question box 226. If the signal is not a CALIBRATE command, the programme returns and waits for an appropriate command. Receipt of an incorrect command at any time returns the programme to the start.

When the controller 14 transmits a CALIBRATE command, this will be recognized by the programme which then commences calibration of timing of pulses derived from the crystal clock 228 connected to pins 1 and 2 of the CPU 208, as indicated by step 230 in FIG. 10. The programme then waits for a further signal on line 88 to stop counting of the pulses and to record the number of pulses counted. This is indicated by step 232 in FIG. 10. These programming steps enable the clock rate of the CPU 208 to be accurately correlated to the signals generated by the controller 14 and transmitted on the line 88 so that the actuator unit 24 can be very accurately calibrated relative to the controller 14. The controller 14 can be arranged to have a precisely defined time base so that it therefore is able to accurately calibrate a multiplicity of actuators 24 which do not have accurately selected components and would therefore not necessarily have a very accurately known time base.

Moreover, the calibration procedures can be carried out just prior to dispatch of signals to activate the detonator units so as to minimize the possibility of errors owing to changing conditions of temperature and pressure or the like.

In the preferred arrangement, the signal on the line 88 to stop the timer is in fact another BLAST code generated by the controller 14, the BLAST code being selected so as to be identifiable with the particular blast e.g. user identity, date, sequential blast number, etc. The question box 234 in FIG. 10 indicates the required programming step. If the next signal received on the line 88 is not a correct BLAST code, the programme returns to the start so that recalibration will be required before the detonator unit 22 can be armed.

If on the other hand the BLAST code is correct the programme then calculates the exact delay required by the actuator 24 prior to generating signals for explosively activating the detonator unit 22. This is indicated by the programming step 236 in FIG. 10. For instance, the actuator unit 24 may be required to actuate the detonator unit 22 precisely 10 ms after a precise predetermined delay from commencement of the blasting sequence which is initiated by generation of a BOOM command by the controller 14. The information regarding the particular delay is stored in the EPROM 212 and the programme is then able to calculate the exact number of clock cycles for the microcomputer 206 required to give the precise delay. The calibration information has in the meantime been stored in RAM within the input/output device 210.

Following this step, the actuator unit 24 may signal to the controller 14 that it is functioning correctly and that appropriate signals have been received. Signals for transmission back to the controller 14 are carried by line 90 which is coupled to pin 4 of the CPU 208. This is indicated by step 238 in FIG. 10. The arming of the detonator unit 22 is indicated by step 240 in which an ARM signal is generated on pins 31 and 32 of input/output unit 210. The programme then is arranged to set a predetermined period say 5 seconds in which it must receive a BOOM command signal on the line 88 from the controller 14 for activation of the detonator unit 22. If the BOOM command signal is not received within the 5 second period, the programme returns to the start so that recalibration procedures etc. will be required in order to again be in readiness for actuation of the detonator unit 22. These programming steps are denoted 242, k244 and 246 in FIG. 10. The BOOM command signal on line 88 must be a correct eight bit pattern of signals otherwise the programme will again return to the start, as indicated by the question box 248. If the BOOM command is correct, the required delay is retrieved from the RAM in the input/output unit 210 and the delay is waited, as indicated by programming steps 250 and 252. At the end of the delay period, a signal is passed to the input/output unit 210 the output pins 29 and 30 of which go high. These output pins are connected by current drivers 254 and 256 to the lines 96 and 94 and the current drivers supply a fusehead actuating current, say 1.5 amps, required to fuse the element 62 and ignite the flashing charge 64 and thus actuate the detonator unit 22. This is indicated by the programming step 258. Actuation of the detonator unit 22 of course destroys the detonator assembly 6 so that the controller 14 will be aware of successful operation of the detonator assembly by its silence. If however there has been a malfunction, the programme includes a question box 260 which determines whether the CPU is still functioning and if so this information is communicated to line 90 for transmission to the controller 14. The programme then returns to the start whereupon the detonator unit is again made safe, this being indicated by programming steps 260 and 262.

Figure 11:
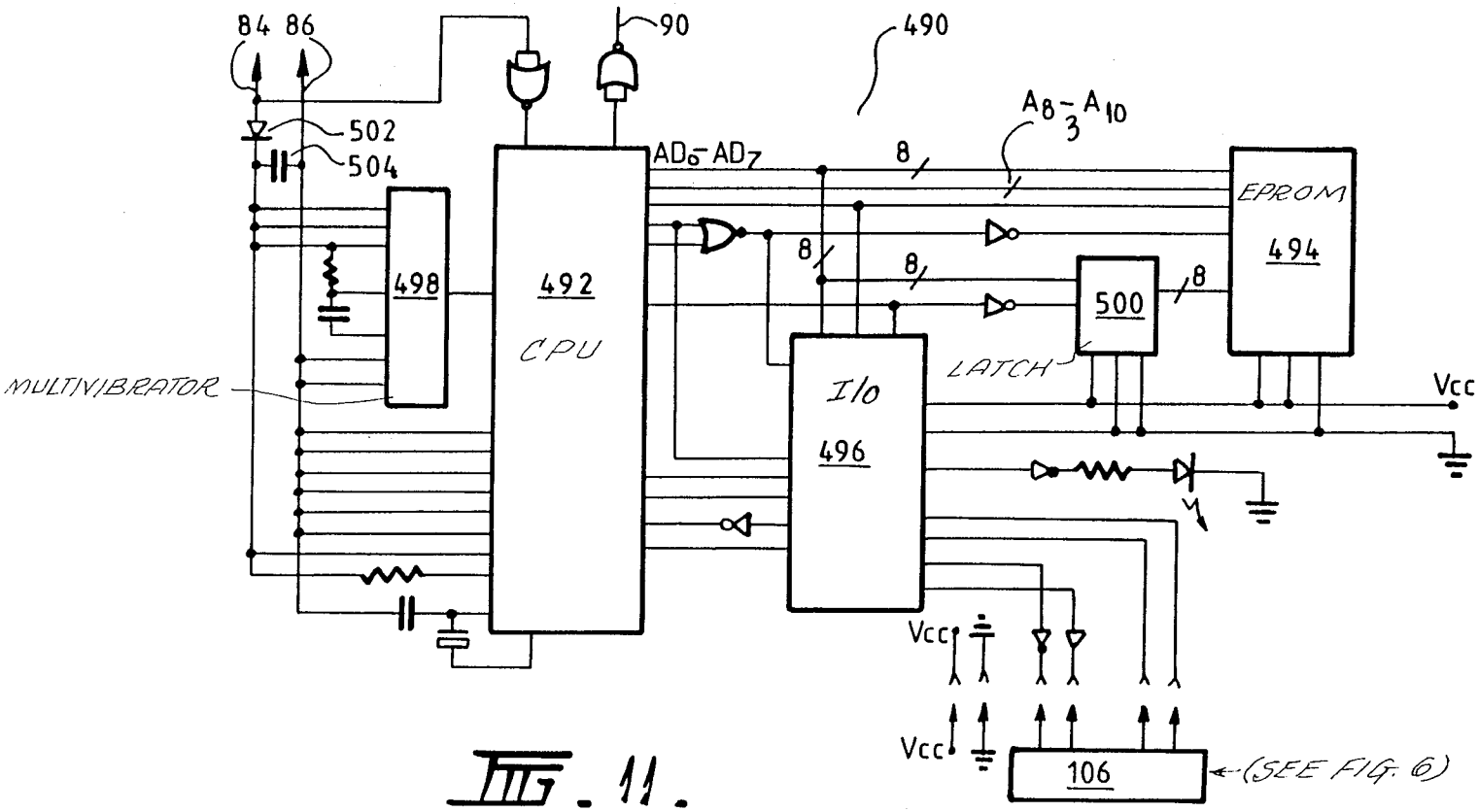
FIG. 11 is a schematic circuit diagram for another embodiment of a detonator actuator unit.

FIG. 11 illustrates alternative circuitry for the actuator unit 24. In this arrangement, the power supply lines 84 and 86 are used for communication from the controller 14 to the actuator assembly 6. The same lines may be utilised for communications in the reverse direction if a transducer unit 26 is utilised. Alternatively the line 90 may be used for that purpose if required as shown in FIG. 11. The circuit of FIG. 11 essentially comprises a microcomputer 490 comprising and 8085 CPU 492, a 2716 EPROM 494, an 8155 input/output unit 496, a 74123 triggerable monostable multivibrator 498 and a 74377 eight bit latch 500. These components are connected together as indicated in the connection table (FIG. 12) so as to function as a microcomputer as is known in the art. The principle function of the microcomputer 490 is to carry out the programming steps indicated diagramatically in FIG. 10 as well as FIG. 14 where a transducer unit 26 is employed.

Power supply for the detonator assembly 6 is derived from the voltage applied to the line 84 by the controller 14 via the conductors 10 and wires 20 of FIG. 2. The voltage is stored in a storage capacitor 504. The diode 502 ensures the capacitor 504 cannot discharge itself back along the path to pin 5 of the CPU 492, or to the controller 14 along conductors 10 and 20. The normal level applied to the line 84 is selected to be 2.4 volts which is sufficient to charge the capacitor 504 and maintain the CPU 492 but insufficient to generate a response on the input pin 5 of the CPU 492 which is connected to the line 84. When signals are required to be transmitted to the assembly 6 from the controller, the controller is arranged to send a pulsed waveform the peak voltages of which are say 5 volts which is above the threshold level for a positive input to the pin 5 of the CPU 492. By this means, various coded signals can be sent from the controller 14 to the assemblies. The output pin 4 could be used to apply voltages to the line 84 for communication from the assembly 6 to the controller, provided the time sequencing were correctly arranged. Alternately, the output pin 4 could be connected to the return communication line 90 of the bus.

Returning now to FIGS. 3 and 4, the transducer unit 26 comprises a tubular housing 264 preferably of aluminium and formed with a spigot portion 266 which interlocks with the open end of the housing 176 of the actuator unit 24. The shape is such that it cannot mate with the unit 22. The housing has partitions k268 and 270 which define a chamber in which a circuit board 273 for electronic and/or electrical components is located. The partitions 268 and 270 can be used to support the board 273 as well as supporting electrical connectors 272 and 274 for the bus 82. The housing 264 has an opening to permit access to a transducer element 276 which is sensitive to surrounding temperature, pressure, humidity or other parameters as required. For temperature sensing the element 276 could be bonded to the inner surface of the housing 264. The transducer unit 26 may have several transducer elements and so be responsive to a number of different parameters. When the spigot portion 266 is interlocked with the end of the actuator unit 24, the connector 272 mates with the connector 200 so that the bus 82 extends through the respective units. In its simplest configuration, the board 273 would simply carry any circuitry which might be necessary for correct operation of the transducer element 276 and for coding of its output for application to lines 98 and 100 of the bus 82.

Figure 13:
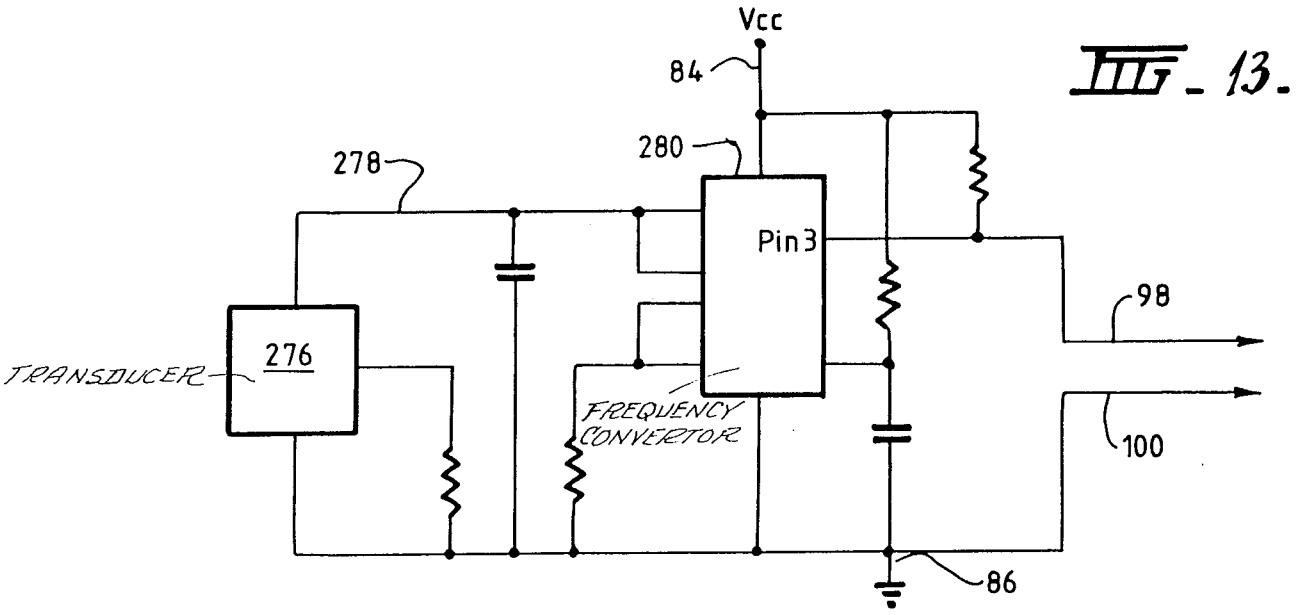
FIG. 13 is a schematic circuit diagram for an embodiment of a transducer unit.

FIG. 13 shows an example of one such circuit. In this arrangement the output 278 of the transducer element 276 is connected to the input of a voltage to frequency converter 280 which may comprise an LM 331 circuit. The resistors and capacitors connected to the converter 280 are well known and need not be described in detail. Output from pin 3 of the converter 280 is connected to the line 98 of the bus, the line 100 being ground. The frequency of the signal on the line 98 will be proportional to the output of the transducer element 276 and thus be proportional to the temperature pressure humidity etc. to which the element 276 is exposed. The signal on the line 98 is applied to the CPU 208 for conversion to digital form and outputted on pin 4 which is coupled to line 90 of the bus for transmission to the controller 14.

FIG. 14 shows schematically a flow chart for processing by the microcomputer 206 of the variable frequency output signals of the transducer unit 26. The flow chart of FIG. 14 is an example of the programme denoted by 224 in FIG. 10. The first step in the programme is to clear a timer, as indicated by programme step 282. The timer may be located in the input/output unit 210. The programme then waits for the rising edge of the first received pulse on the line 98, as indicated by step 284. The programme then starts the timer and waits for a falling edge of the same pulse, as indicated by steps 286 and 288. The timer is then stopped and its value is indexed into a conversion table stored in the EPROM 212, as indicated by steps 290 and 292. The programme then looks up the value of the parameter such as temperature, pressure, etc. and sends an appropriately encoded signal to the controller 14 via line 90, as indicated by steps 294 and 296. The programme then returns to the main control programme of the actuator unit 24, as indicated in FIG. 10.

In circumstances where communication from the detonator assemblies 6 to the controller 14 is not required, the connector unit 42 need only be capable of receiving signals from the controller 14 and does not need to transmit signals thereto. Thus, the unit 42 need only include a radio receiver for use with radio controlled arrangements as in FIG. 1, or line connectors for use in wire systems as shown in FIG. 2.

Returning once again to FIGS. 3 and 4, the battery unit 38 comprises a tubular housing 298 with a spigot portion 300 which is interlockable with the open end of the housing 264 of the transducer unit 26. The spigot 300 is also shaped so that it can be plugged directly into the housing 176 of the actuator unit 24 in instances where the transducer 26 is not required. The shape of the spigot 300 is such that it cannot be inserted into the open end of the housing 44 of the detonator unit 22. The unit 38 includes partitions 302 and 304 which define a chamber within which a battery 306 is mounted. The battery provides the power supply on lines 84 and 86 of the bus for the other units in the assembly. In some arrangements, the battery unit 38 may be omitted by arranging for one or more of the other units such as the actuator 24 to have an inbuilt battery or to be provided with energy storgage means such as a capacitor for powering the units or to have power supplied by the controller 14 itself, as on lines 86 and 84 via the lines 20. The battery unit 38 has connectors 308 abd 310 to provide interconnections of the bus 82 through the unit.

FIGS. 3 and 4 also show the expander unit 40 in more detail. The expander unit comprises a tubular housing 312 formed with a spigot 314 which can be inserted into the housings of the units 38, 26 and 24 as required. The housing has partitions 316 and 318 which define a chamber in which a terminal block 320 is mounted. The partitions also support connectors 322 and 324 for the bus 82. FIGS. 3 and 4 also illustrate the connector unit 42. The unit 42 comprises a tubular housing 328 with a closed end wall 330. The housing has a partition 332 which defines a chamber within which a circuit board 334 is mounted. The partition 332 also supports a connector 336. The housing 328 is formed with a spigot portion 338 which is insertable in any one of the units 40, 38, 26 and 24 and the arrangement is such that the connector 336 mates with the complementary connector of the unit to which it is connected. The unit 42 is not however directly insertable in the detonator unit 22.

The circuit board 334 in the unit 42 may comprise a connection block which connects the wires 20 from the controller 14 to the assemblies 6, as in the arrangement shown in FIG. 2. This is the simplest arrangement for the unit 42.

In another alternative arrangement for the unit 42, the board 334 may include an electronic clock and signal generator to enable activation of the actuator unit 24 independently of the controller 14. In this arrangement (not shown) the clock would control a signal generator which would generate signals for actuator unit 24 via the line 88 which signals would normally be generated by the controller 14.

In a further alternative arrangement, the unit 42 may include the radio transceiver 12 which receives signals radiated by the transmitter 15 or the safety unit 16, as in the arrangement of FIG. 1. In this instance, the lines 340 which comprise the input to the circuitry on the board 334 would comprise or be connected to an antenna for receipt of radio signals.

Figure 15:
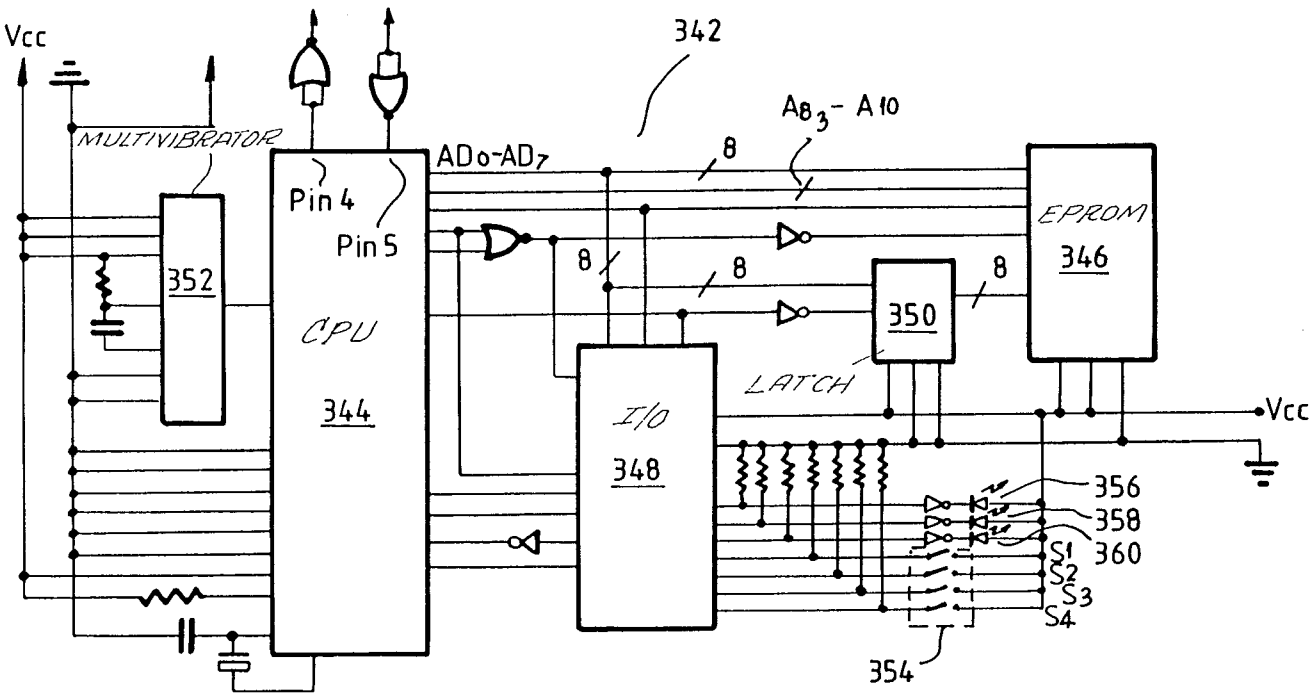
FIG. 15 is a schematic circuit diagram of part of a detonator controller.

FIG. 15 illustrates in more detail part of the circuitry for the controller 14. The circuitry essentially comprises a microcomputer 342 comprising an 8055 CPU 344, a 2716 EPROM 346, an 8155 input/output device 348, a 74123 monostable triggerable multivibrator 352 and a 74377 eightbit latch 350. These components are connected together as indicated by the connection table (FIG. 16) and so that they function as a microcomputer as is known in the art. The principal function of the microcomputer 342 is to generate control signals which are used to control the detonator assemblies 6. The microcomputer also interprets information sent to the controller 14 by the various detonator assemblies 6, input and output to the CPU 344 is via pins 5 and 4 respectively. The circuitry includes a keyboard unit 354, the keyboard having control switches S1, S2, S3 and S4 which are operated in order to perform various steps required for activation of the detonator assemblies 6. The microcomputer includes three LED devices 356, 358 and 360 which provide a visual indication as to which signals have been despatched by the computer 342 to the detonator assemblies 6. The programmes for the microcomputer 342 are stored in the EPROM 346.

Figure 17:
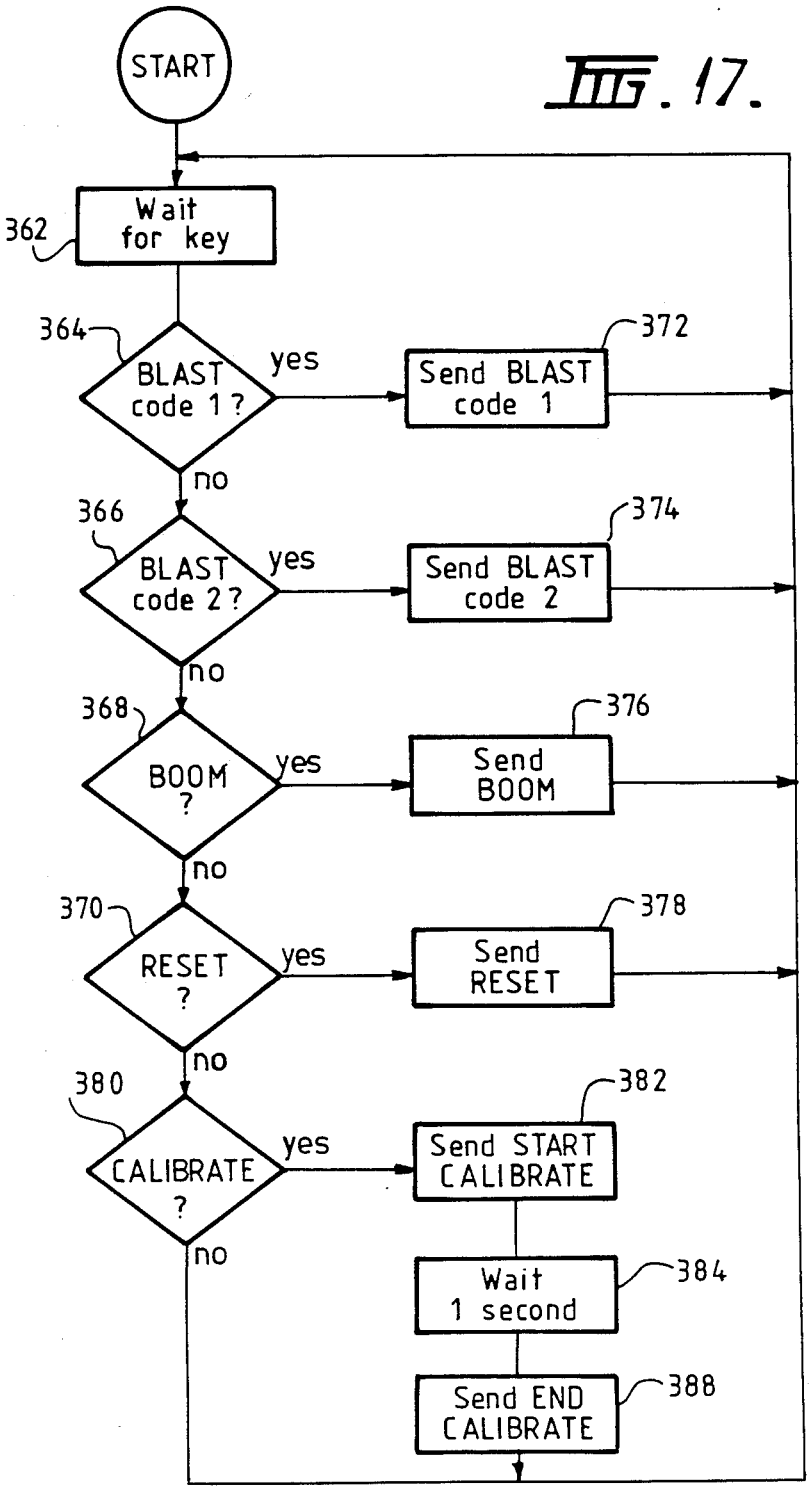
FIG. 17 is a flow diagram illustrating the operation of the controller.

FIG. 17 is a flowchart illustrating the important programming steps which are carried out by the computer 342. On power up, the multivibrator 352 ensures that the CPU 344 is correctly initialised and the programme waits for one of the control keys S1 to S4 to be actuated, as indicated by step 362. The programme then has four question boxes 364, 366, 368 and 370 which determine which if any of the switches S1–S4 have been pressed. The switches can be arranged to generate signals within the CPU 344 corresponding to different COMMAND signals to be transmitted to the assemblies 6. For instance, the switch S1 can be made to represent selection of a first BLAST code in which case the CPU 344 generates the appropriate BLAST code. The programme then arranges for the BLAST code to be sent to the detonator assemblies 6, as indicated by programme step 372. It follows that those detonators which have the first BLAST code will be armed in readiness for operation. After that signal is sent, the programme returns to the start. The switch S2 may represent a second BLAST code which will cause a different BLAST code to be generated by the CPU 444 and sent to the detonator assemblies 6, as indicated by step 374. Those assemblies which have actuator units 24 programmed to respond to the second BLAST code will thereby be armed.

The switch S3 if pressed causes the CPU 334 TO generate a signal causing the armed actuator units 24 to actuate the detonator units 22 connected thereto. These signals comprise the BOOM command and are distinguished by the question box 248 in FIG. 9. The despatch of a BOOM command is indicated by programme step 376 in FIG. 13.

The switch S4 represents a reset switch which can be activated by an operator at any stage during the programme and if pressed a RESET command will be generated by the CPU 344, as indicated by step 378. Receipt of a RESET command by the actuator units 24 causes them to return to the start of their operating programme, as indicated in FIG. 10. The reset signal need not be a specially encoded signal, the actuator units 24 being programmed to automatically reset if any signals other than known sequence of predetermined commands are received. Resetting the actuators 24 will consequently make the detonator units 22 safe so that they cannot be inadvertently exploded. Of course, a detonator unit 22 with fusible links as shown in FIG. 7 cannot reconnect the fusehead conductors 56 and 58 via the fusible links, but will remain safe while power is available to maintain the solid state relays 142 and 144 on.

The controller programme has a question box 380 which is responsive to a manual or programme generated input to commence calibration procedures. The arrangement shown in FIG. 16 shows a step 382 for generation and transmission of a CALIBRATE command to start calibration. This command is the input to box 226 in FIG. 10. The programme then waits for a predetermined period say one second which is accurately known because care is taken to ensure that the crystal oscillator 386 and associated components connected to pins 1 and 2 of the CPU 344 are accurately selected whereby the timing of the CPU 344 is accurately known. At the end of the predetermined period, an END calibrate command is generated as indicated by the step 388. This may be effected by generation of a valid BLAST code. Many variations and enhancements would of course be available in the software for the microcomputer 342.

Figure 18:
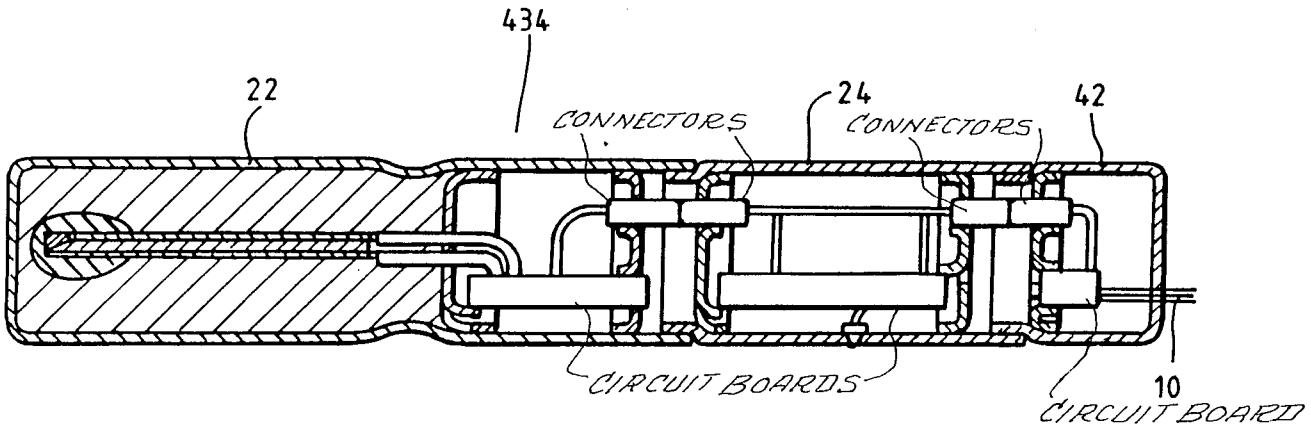
FIG. 18 is a sectional view through an embodiment of a detonator assembly.

FIG. 18 shows a detonator assembly 434 comprising a detonator unit 22, actuator unit 24 and connector unit 42. In this arrangement the connector unit 42 is arranged for connection to the controller 14 by the conductors 10 and wires 20, as in FIG. 2. The detonator assembly 434 receives power directly from the controller 14 and to be actuated at a predetermined interval after voltage has been disconnected from the wires 20. In a blast using these assemblies, it would not matter if the wire 20 or conductors 10 were broken by actuation of assemblies which have been actuated earlier since the assemblies have their own power supplies and will be actuated at a predetermined period after the voltage has been disconnected regardless of whether the conductors 10 or wires 20 remain intact.

Figure 19:
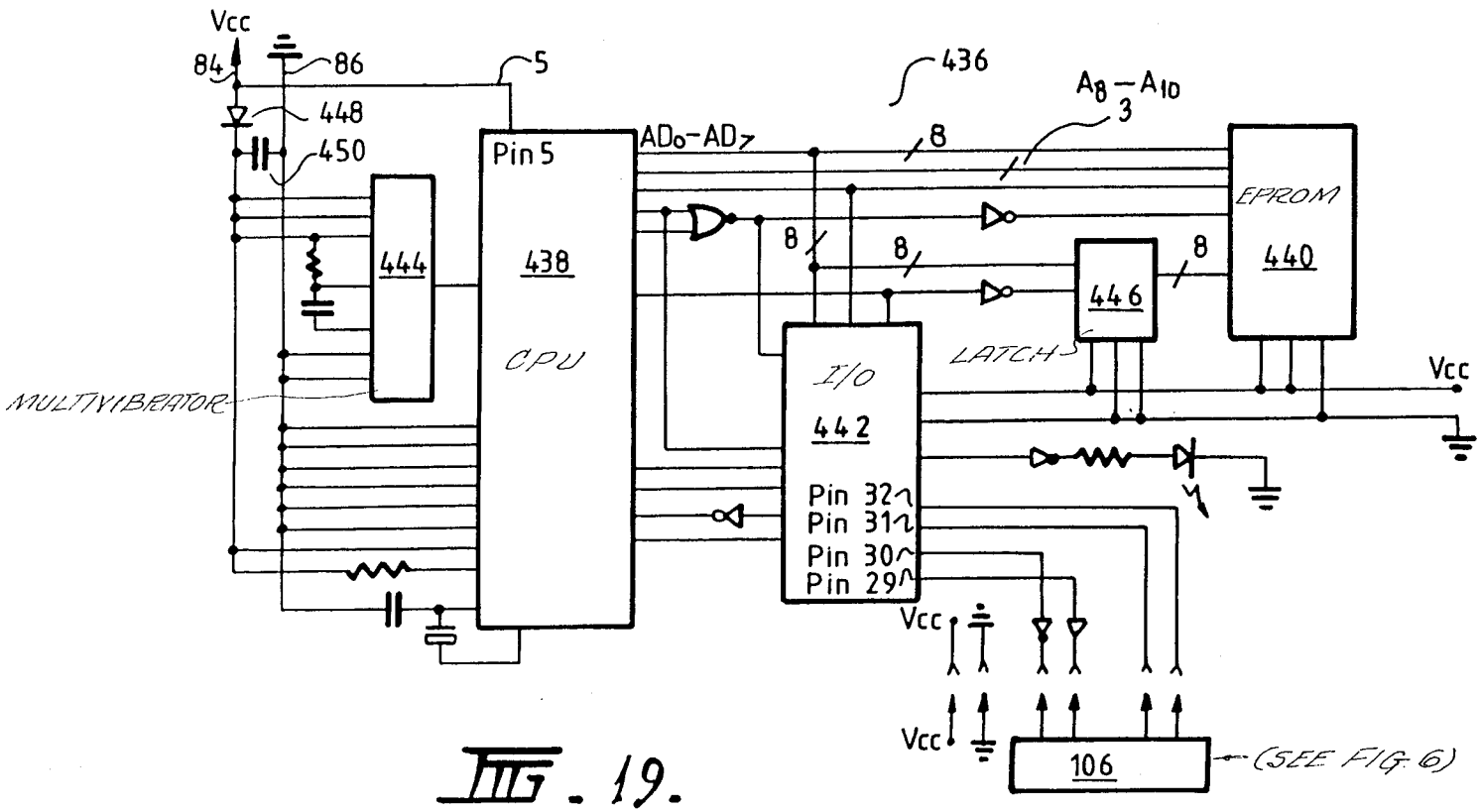
FIG. 19 is a schematic circuit diagram for an embodiment of a detonator actuator unit suitable with assemblies as shown in FIG. 18.

FIG. 19 illustrates in more detail the circuitry for the actuator uinit 24 of assembly 434. The circuitry essentially comprises a microcomputer 436 comprising an 8055 CPU 438, a 2176 EPROM 440, an 8155 input/output device 442, a 743123 triggerable multivibrator 444, and a 74377 eight bit latch 446. These components are connected together as indicated by the connection table (FIG. 20) so that they function as a microcomputer as is known in the art. The principle function of the microcomputer 436 is to generate control signals which are used to control the detonator assembly 436. In this arrangement, the power supply line 84 and ground line 86 are connected to the conductors 10 so as to establish direct connection to the controller 14. The voltage on the power supply line 84 charges a storage capacitor 450. The diode 448 ensures that the "power sense"line 5 can detect the discontinuation of power from the controller 14 on line 84 even while the capacitor 450 maintains the actuator 436 on. The capacitor 450 is chosen so that it will have sufficient charge to power the circuitry for the microcomputer 436 after the voltage supply level has been removed from supply line 84. As soon as the multivibrator 444 operates after power on, it will properly initialise the CPU 438. The input pin 5 of the CPU is connected to the line 84 so as to indicate a "power up". After power up, the microprocessor 436 will operate to generate an ARM command which is communicated via pins 31 and 32 of the unit 472 to the detonator unit 22. The CPU 438 will then wait until the voltage falls to zero or below a predetermined level on line 84, and, after a predetermined period, the fusehead actuating current will be generated to initiate the flashing charge 64 via pins 29 and 30 to cause activation thereof.

Figure 21:
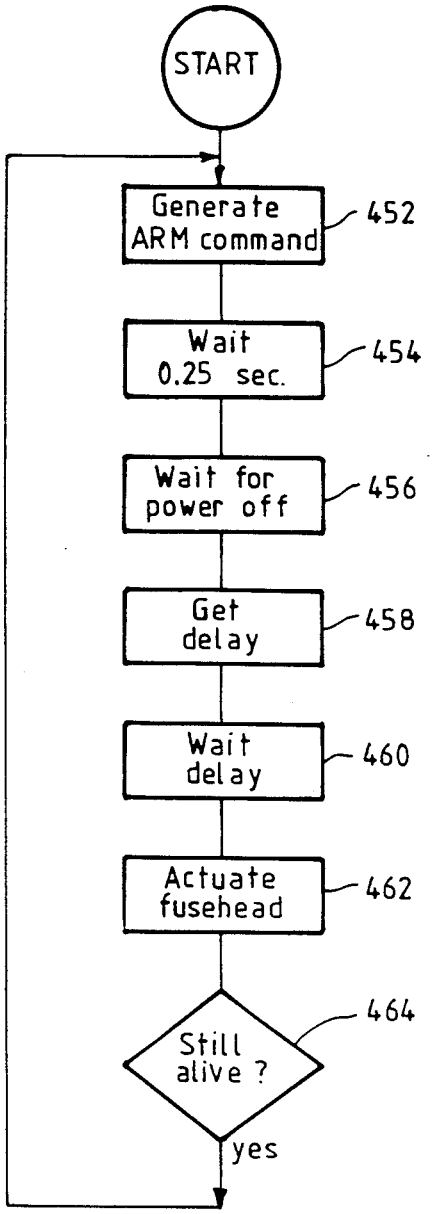
FIG. 21 is a flow chart illustrating the operation of the circuit shown in FIG. 19.

FIG. 21 is a flowchart illustrating the important programming steps which are carried out by the microcomputer 436. The programme starts on power up and then immediately generates an ARM command, as indicated by step 452, for the detonator unit 22. The ARM command will then wait for a predetermined period say 0.253 seconds before taking any other action. This prevents premature operation of the system as the result of transients or the like which might occur shortly after power up, kand allows time for mechanical relays in the detonator unit 22 to switch. This step is indicated by programming step 454. The programme then waits for the voltage to fall on line 84, as indicated by step 456. When the voltage on line 84 falls to zero or below a pre-determined level the CPU will then wait a pre-determined delay so that the detonator assembly 434 will be actuated in the correct sequence relative to other assemblies. This is indicated by programming steps 458 and 460 representing retrieval of the delay period from the EPROM 440 and thereafter waiting the delay period. At the end of the delay period, the programme then causes generation of the fusehead actuating current for actuation of the detonator unit 22, as indicated by step 462. The programme then passes to a question box 464 which ascertains whether the programme is still operating indicating whether the detonator unit 22 has been successfully actuated or not. If it has not, it will return to the step 452.

Figure 22:
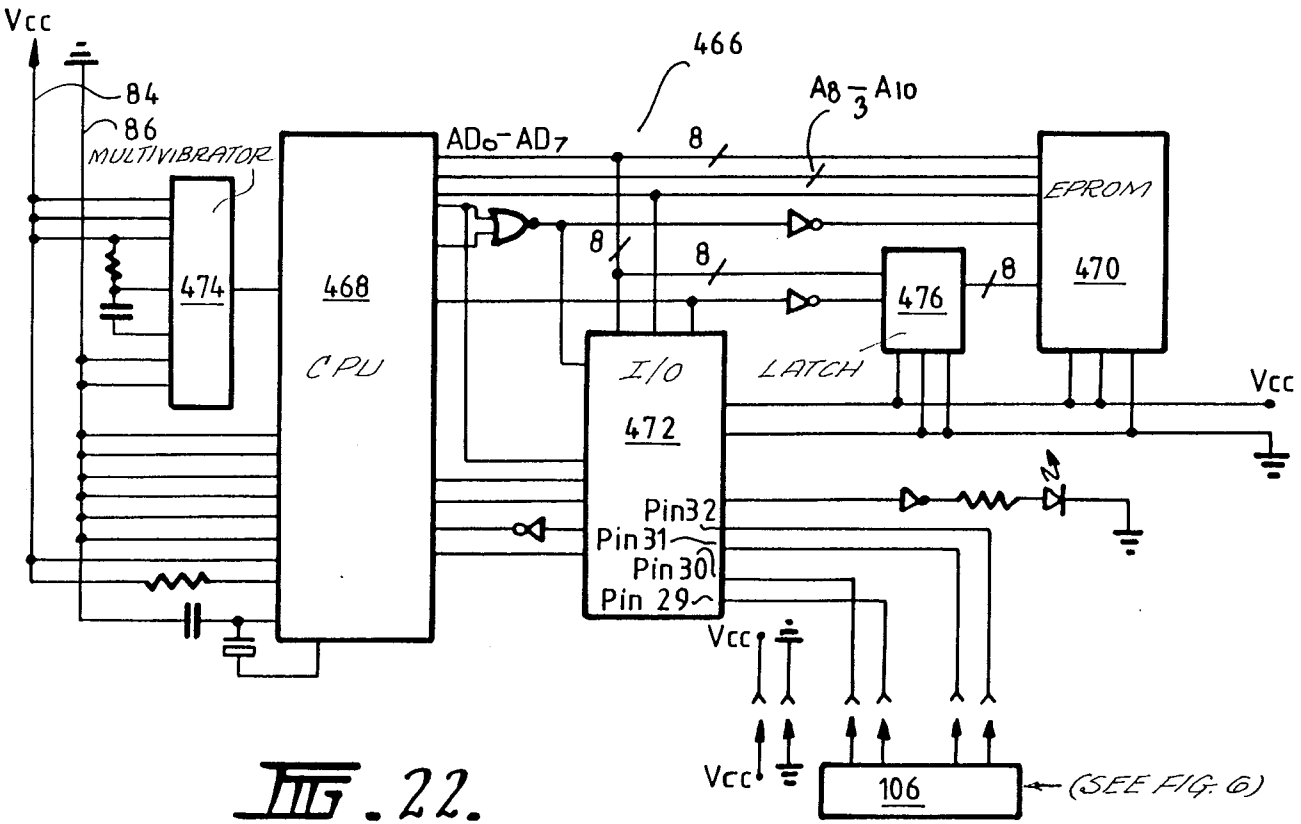
FIG. 22 is a schematic circuit diagram for an embodiment of a detonator actuator unit.
Figure 24:
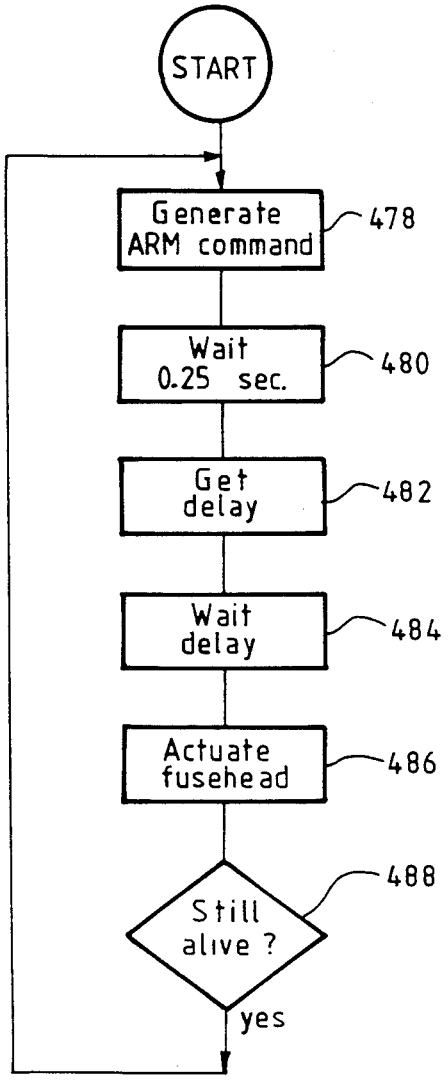
FIG. 24 is a flow diagram illustrating the operation of the detonator actuator circuit shown in FIG. 22.

FIG. 22 shows an alternative circuit for use in the actuator unit 24 of the assembly 436, shown in FIG. 19. In this arrangement the detonator assembly 434 is arranged to be actuated a predetermined period after power has been applied thereto via the conductors 10 and wires 20 of the arrangement shown in FIG. 2. The circuit of FIG. 22 essentially comprises a microcomputer 466 comprising an 8085 CPU 468, a 2176 EPROM 470, and 8155 input/output unit 472, a 74123 monostable triggerable multivibrator 474, and a 74377 eight bit latch 476. These components are connected together as indicated by the connection table (FIG. 23) so that they function as a microprocessor as is known in the art. The microcomputer has programmes stored in its EPROM 470 for carrying out primarily the programme shown diagramatically in the flowchart of FIG. 24.

On the application of a voltage above a predetermined level, e.g. 2.4 volts, on the supply line 84, the multivibrator 474 will reset the CPU 468 and various circuit and programming functions are properly initialised. The CPU 468 will then start running and its first function will be to generate an ARM command on pins 31 and 32 of the unit 472 for the detonator unit 22. This is indicated by the programming step 478 of FIG. 24. The programme then waits a fixed delay period as indicated by step 480. The fixed delay period say 0.25 seconds, is provided so as to prevent inadvertent operation caused by transients or the like which might occur shortly after power up, and allow time for relays to switch. All of the detonator assemblies for a particular blast would have the same fixed delay period. The programme then reads a pre-selected delay from the EPROM 470, as indicated by programme step 482. The pre-selected delay can be different for particular actuator units 24 so that a predetermined blast sequence can be established. The programme then waits for the preselected delay period, as indicated by programme step 482 then causes generation of the fusehead actuating current via pins 29 and 39 of the unit 472 as indicated by step 486. The BOOM command appears on pins 29 and 30 of the unit 472. The BOOM command causes the detonator unit 22 to explode.

If the unit 22 fails to explode, the programme will pass to question box 488 which will return the programme to the start if the microcomputer 466 has remained in tact.

Many modifications will be apparent to those skilled in the art. For instance, integration techniques could be used to integrate circuits which are shown in non-integrated form.

I claim:

1.An actuator for a detonator responsive to at least one input signal from a control device comprising:

means for inputting a predetermined input signal from said control device, the predetermined input signal being a voltage step signal, the leading edge of which comprises an arm signal and the trailing edge of which an actuate signal;

means for generating an output arm signal upon input of said predetermined input signal to cause said detonator to change from a disarmed state to an armed state in which said detonator is capable of being actuated; and means for generating an output actuate signal to cause an explosive actuation of said detonator a predetermined period after the input of said predetermined input signal.

2. A detonator actuator system comprising:

a control device microcomputer including:

a memory that stores an arm code and an actuate code, an arm key, means for generating and emitting an arm signal derived from said arm code upon actuation of said arm key, an actuate key, and means for generating and emitting an actuate signal derived from said actuate code if said actuate key is actuated within a first predetermined period after actuation of said arm key;

an actuator for a detonator including:

means for inputting said arm signal and said actuate signal, means for generating an output arm signal upon input of said arm signal to cause said detonator to change from a disarmed stated to an armed state, and means for generating an output actuate signal upon input of said actuate signal to cause explosive actuation of said detonator a second predetermined period after the input of said first predetermined input; and wherein the memory of the control device microcomputer holds a reset code and includes means for generating an output reset signal that renders the detonator incapable of being explosively actuated on failure to actuate the actuate key within the predetermined period after actuation of the arm key until said output arm and output actuate signals are received within said predetermined period.

3. A detonator actuator system comprising:

a control device microcomputer including:

a memory that stores an arm code and an actuate code, an arm key, means for generating and emitting an arm signal derived from said arm code upon actuation of said arm key, an actuate key, means for generating and emitting an actuate signal derived from said actuate code if said actuate key is actuated within a first predetermined period after actuation of said arm key, and means for generating a calibrate signal upon actuation of one of a calibrate key and a program instruction;

an actuator for a detonator including:

means for inputting said arm signal, said actuate signal, and said calibrate signal, means for generating an output arm signal upon input of said arm signal to cause said detonator to change from a disarmed stated to an armed state, means for generating an output actuate signal upon input of said actuate signal to cause explosive actuation of said detonator a second predetermined period after the input of said first predetermined input, means for calibrating said second predetermined period on a time basis relative to said control device, and means for storing said calibrated second predetermined period.

4. A detonator actuating system according to claim 3, further including a transducer unit which is couplable to the actuator such that all the appropriate electrical connections are made by the coupling, the transducer being responsive to a preselected physical parameter and being able to generate condition signals related to said parameter so as to permit variation of the calibration of the actuator, the variation being communicated to the control device.

5. A control device microcomputer for use with detonators comprising:

a memory that stores an arm code and an actuate code;

an arm key;

means for generating and emitting an arm signal derived from said arm code upon actuation of said arm key;

an actuate key;

means for generating and emitting an actuate signal derived from said actuate code if said actuate key is actuated within a first predetermined period after actuation of said arm key; and wherein the memory of the microcomputer holds a reset code, and includes means for generating an output reset signal that renders the detonators incapable of being explosively actuated on failure to actuate the actuate key within the predetermined period after actuation of the arm key until said output arm and output actuate signals are received within said predetermined period.

6. A control device according to claim 5 wherein the arm signal and actuate signal from the control device to the actuator is a voltage step signal in which the leading edge of the signal comprises the arm signal and the trailing edge the actuate signal.

* * * * *